United States Patent [19]

Guyot et al.

[11] 3,995,683

[45] Dec. 7, 1976

[54] CONTINUOUS CASTING APPARATUS

[75] Inventors: André Guyot, Thumeries; Bernard Mulliez, Roubaix, both of France

[73] Assignee: Fives-Cail Babcock, Paris, France

[22] Filed: Apr. 7, 1975

[21] Appl. No.: 565,543

[30] Foreign Application Priority Data

Apr. 5, 1974 France ..... 74.12069
May 14, 1974 France ..... 74.16553

[52] U.S. Cl. ..... 164/282
[51] Int. Cl.[2] ..... B22D 11/128
[58] Field of Search ..... 164/282; 72/239; 214/1 BB

[56] References Cited

UNITED STATES PATENTS

| | | | |
|---|---|---|---|
| 3,527,286 | 9/1970 | Meitz | 164/282 |
| 3,763,923 | 10/1973 | Gollucci | 164/282 |
| 3,783,934 | 1/1974 | Golde et al. | 164/282 |
| 3,889,344 | 6/1975 | Bode, Jr. et al. | 29/252 |

FOREIGN PATENTS OR APPLICATIONS

| | | | |
|---|---|---|---|
| 1,586,271 | 1/1970 | France | 164/282 |
| 1,285,095 | 12/1968 | Germany | 164/282 |

*Primary Examiner*—Ronald J. Short
*Attorney, Agent, or Firm*—Kurt Kelman

[57] ABSTRACT

Individual guide rolls or pairs of guide rolls in a common cage may be removed from the guide rack of a continuous casting machine by a hoisting mechanism mounted on a vehicle traveling in a path parallel to the path of the cast metal defined by the rack. The hoisting mechanism includes two track members pivotally mounted on the vehicle. A carrier equipped to be attached to a roll or cage, a slide, and a link chain for raising and lowering the carrier are associated with each track member. The slide moves on or in the track member, the carrier moves on the slide and is automatically coupled to and disengaged from the associated slide in such a manner that a roll attached to the carriers is guided by respective faces of the two slides into or out of the rack to a position which permits travel of the vehicle.

10 Claims, 11 Drawing Figures

CONTINUOUS CASTING APPARATUS

This invention relates to continuous metal casting apparatus, and particularly to devices for removing and installing guide rolls in the guide rack extending downward and away from the lower orifice of the casting mold.

It has been proposed in French Pat. No. 1,586,271 to provide a casting apparatus of the type described with a vehicle traveling in a path approximately parallel to that of the cast metal in the guide roll rack and carrying two guide elements which engage the roll while suspended from a hoisting mechanism on the vehicle. The known apparatus is somewhat difficult to align with the position of a roll in the rack, and difficulties sometimes arise during transfer of a roll between the vehicle and the guide roll rack.

It is a primary object of this invention to provide a casting apparatus with an improved arrangement for removing rolls for repair and replacement, and for installing rolls in the guide rack.

With this object and others in view, as will hereinafter become apparent, the invention provides an improvement in a casting apparatus having an upright mold and a guide rack for guiding a strand of cast metal discharged from the lower orifice of the mold in a first path downwardly away from the mold orifice, the path being defined between two rows of guide rolls having respective axes of rotation extending in a common direction. A vehicle is guided on rails or beams in a second path spaced from the first path and substantially parallel thereto.

The improvement contributed by this invention resides in part in a hoisting arrangement for the rolls in the guide rack which includes at least one track member mounted on the vehicle for pivotal movement about a pivoting axis extending in the common direction of the roll axes. A slide member is mounted on the track member, or on each track member if there are two, for movement transverse to the afore-mentioned common direction. Each slide member has a face parallel to the direction of movement of the slide member and transverse to the two paths. A moving device moves a roll toward and away from one of the rows of the guide rack in guiding engagement with the face or faces of the slide member or members.

Other features, additional objects, and many of the attendant advantages of this invention will readily be appreciated as the same becomes better understood by reference to the following detailed description of preferred embodiments when considered with the appended drawing in which.

Figure 1:
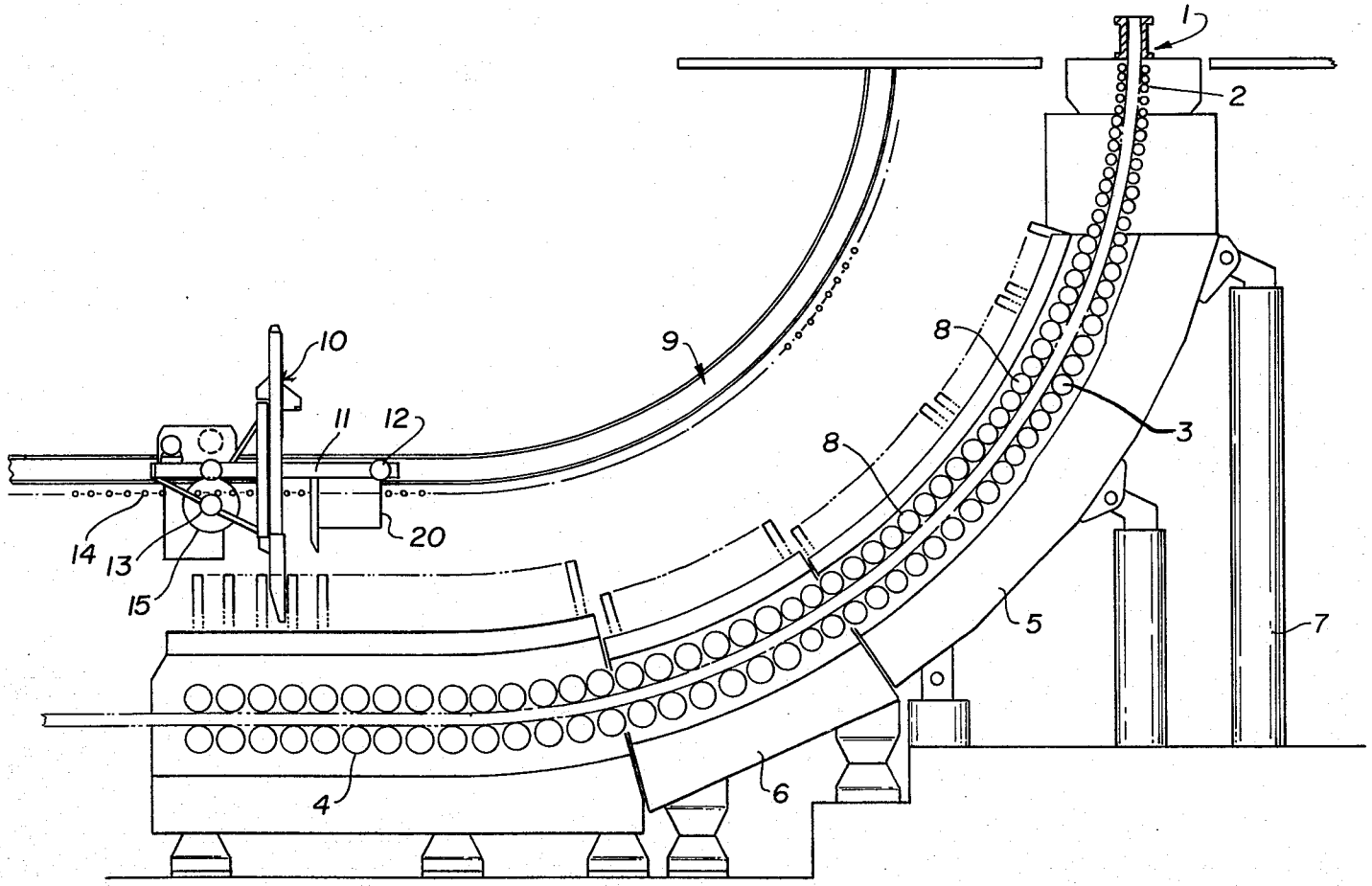
FIG. 1 shows continuous casting apparatus of the invention in fragmentary side elevation.

Referring now to the drawing in detail, and initially to FIG. 1, there is shown only as much of an otherwise conventional, continuous steel billet casting machine as is necessary for an understanding of the invention. The machine has an upright, tubular mold 1, and the strand of metal continuously discharged from the lower orifice of the mold is guided in an arc from its initially vertical path of movement into a horizontal path by two spacedly parallel rows of rolls 8 having parallel, horizontal axes of rotation. The rolls 8 constitute a discharge rack 2 subjacent the mold 1 which is followed by the main section 3 of the curved guide-roll rack, and then by pinch rolls 4 driven in a known manner, not shown. The guide rolls 8 of the main section 3 are mounted on two curved beams 5,6 which are supported on columns 7.

I beams or rails 9, of which only one is seen in FIG. 1, are spacedly parallel to the guide-roll rack and are fixedly mounted on the supporting structure of the machine, represented in FIG. 1 by the columns 7, above the guide rack, in a manner not specifically illustrated. One portion of each beam 9 is straight and horizontal, the remainder curves upwardly. This invention is particularly concerned with a carriage 10 which travels on the beams 9 on wheels 12 mounted on the frame 11 of the carriage. The carriage is moved by pinions 13 meshing with respective racks 14 on the two beams 9 and driven by an electric motor. The shaft of each pinion 13 carries a brake disc 15 to ensure the safety of the device in the event of motor break down, as is best seen in FIG. 2 to 6 which show the carriage 10 and cooperating other elements of the machine on a larger scale.

A dual hoisting mechanism on the carriage 10 includes two link chains 16. Each pin hingedly connecting the links of the chains carries a central, circumferentially grooved, circular disc and two cylindrical outer discs which are engaged by respective rows of teeth on a double gear 17 over which each chain is trained, while the central disc is backed by a stationary guide, not shown, in a housing 18 which permits the chain not only to act as a tension member during the removal of a roll 8 from the guide rack, but also to push the roll downward into the rack. Each gear 17 is coupled directly to an individual hydraulic motor 19 having an adjustable low rotary speed and equipped with a built-in hydraulic brake so that each chain 16 may be driven while the other chain stands still. Each housing 18 and the associated gear 17 and motor 19 are arranged at the upper end of a track 27 mounted on the frame 11. A power unit on the frame 11 is arranged in a housing 20 which obscures a motor-driven pump and other elements of a conventional, remotely controlled, hydraulic system which supplies the two motors 19 and other hydraulic devices presently to be described.

Figure 4:
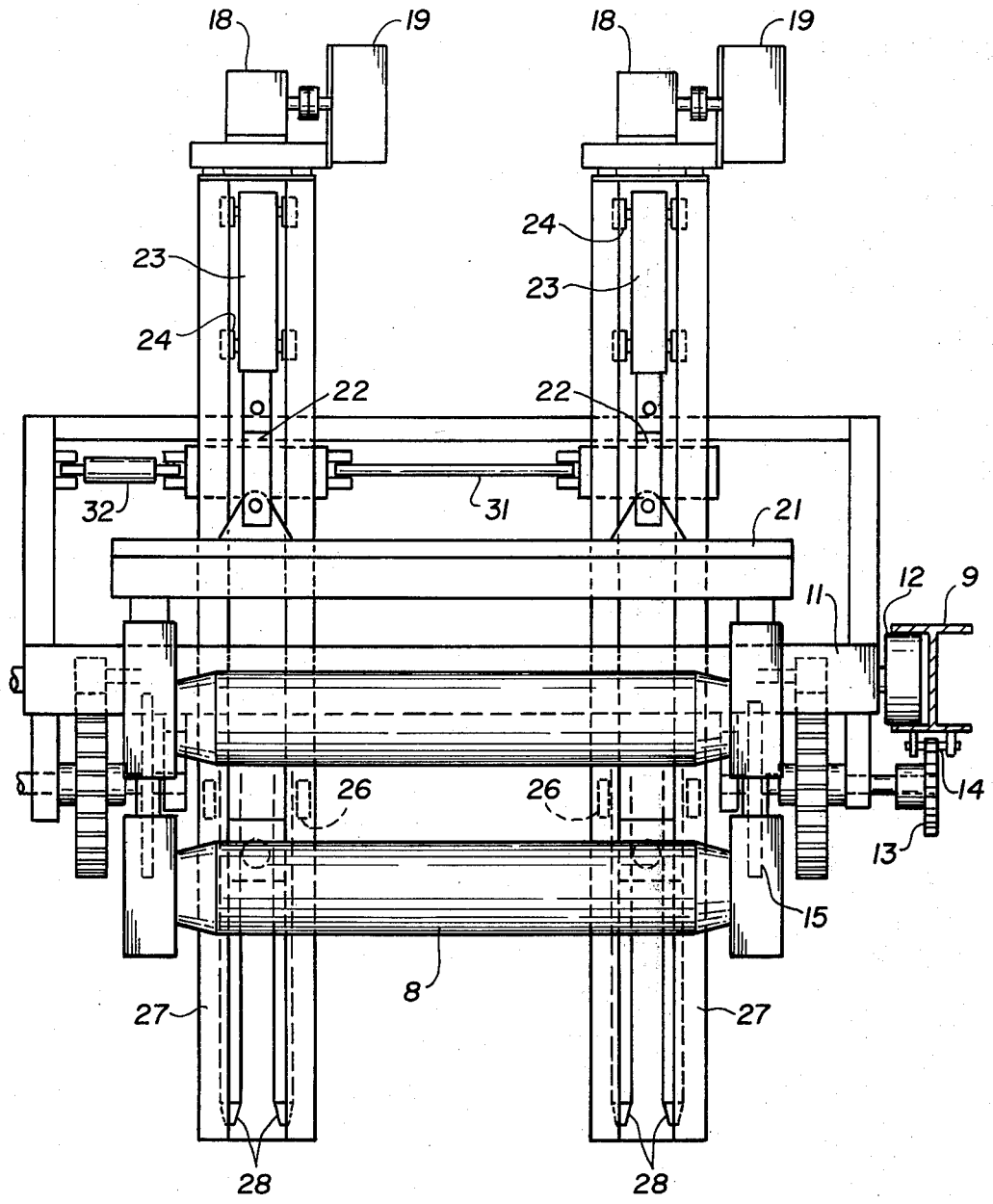
FIG. 4 is a fragmentary rear view of the device of FIG. 2 and of associated elements of the apparatus.
Figure 7:
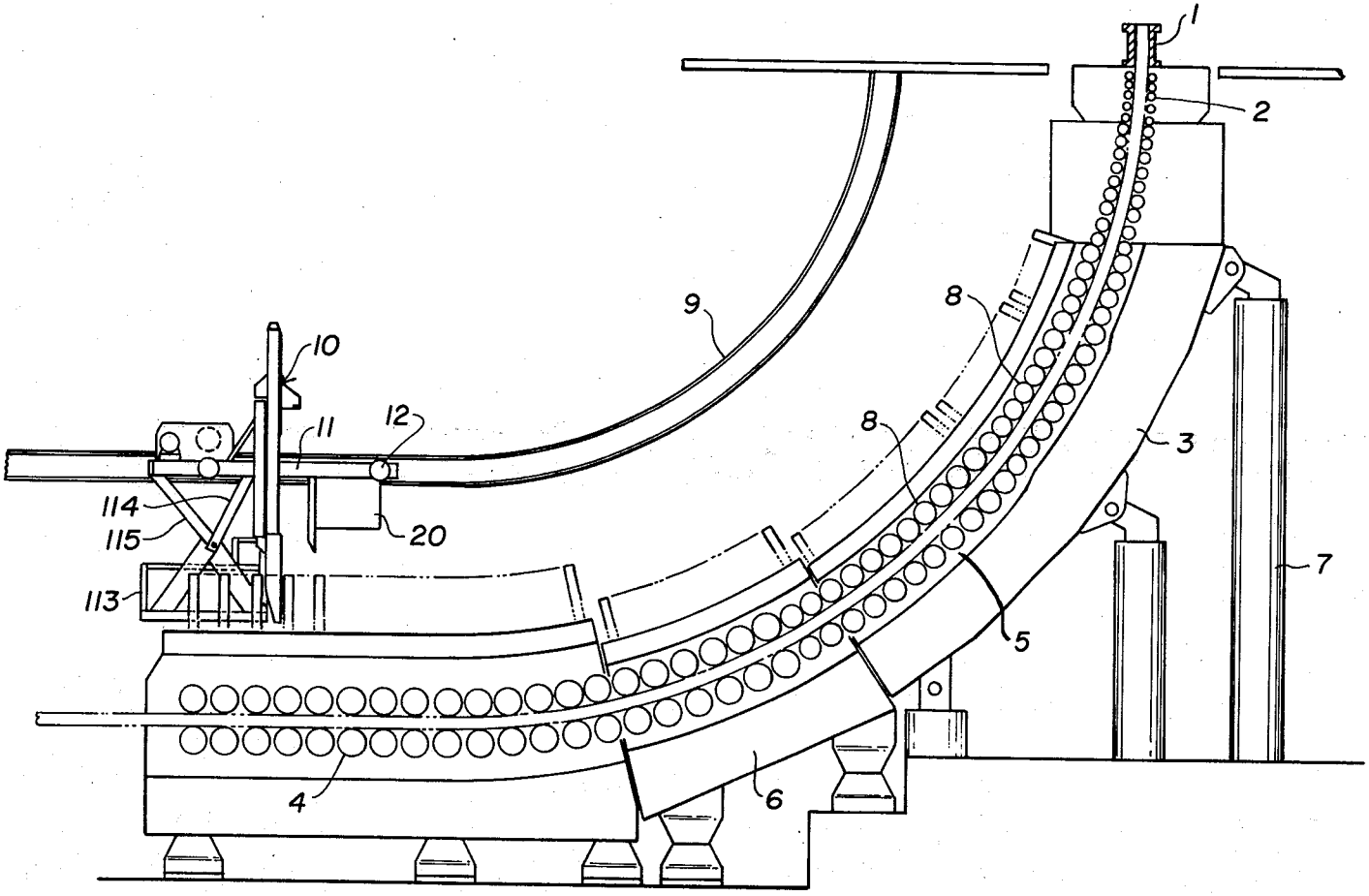
FIG. 7 illustrates a modification of the apparatus of FIG. 1 in a corresponding view.

One end of each chain 16 is attached to a carrier 23 from which a hanger 22 depends, each hanger 22 being equipped to grip one axial end of the cage 21 in which a guide roll 8 or a pair of guide rolls is mounted. As is best seen in FIG. 4, each carrier 23 has four wheels 24 traveling on vertical guide faces 28 in a longitudinal groove of a vertically elongated slide 25, the slide itself moving on wheels or rollers 26 in an associated track 27. When the guide rolls 8 are lifted from the rack sections, they roll on surfaces of the slides 25.

Each track 27 is mounted on the carriage frame 11 for pivotal movement about a shaft 29 whose axis is parallel to the axes of the guide rolls 8, and for axial movement with the shaft in the bearings of the latter. Each track 27 may be tilted about the axis of the shaft 29 by a double-acting hydraulic cylinder 30 (FIGS. 2, 3), and the two tracks 27 may be shifted axially in unison by a double-acting hydraulic cylinder 32 (FIG. 4), the two tracks 27 being coupled by a hingedly fastened connecting bar 31. The hangers 22 may thus be aligned with a guide roll cage 21 to be gripped by suitable movement of the carriage 10 followed by fine adjustment by means of the hydraulic cylinders 30, 32, and the same procedure is followed in installing guide rolls in the rack 2,3,4.

Figure 5:
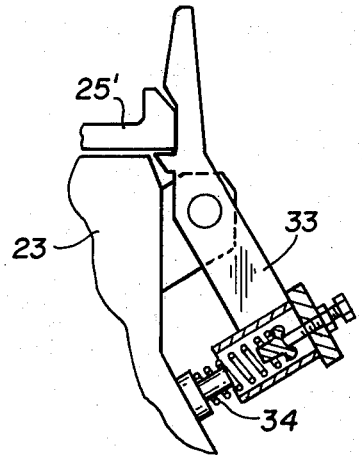
FIG. 5 shows a detail of FIG. 2 on a larger scale.

Each slide 25 is entrained by the associated carrier 23 when the carrier is raised or lowered by a chain 16. As is best seen in FIG. 5, a detent lever 33 is mounted on the carrier 23 and biased counter-clockwise by a helical compression spring 34 whose tension may be adjusted. A notch in the arm of the lever 33 remote from the spring 34 has cam faces cooperating with a cam element 25' at the top edge of the slide 25 to latch the slide to the carrier 23 when the carrier, during its upward movement, reaches the top of the then stationary slide 25, and to release the slide from the carrier 23 when the slide 25 is stopped in its downward movement by abutment against a guide roll cage 21, as is shown in FIG. 3, while the carrier 23 may descend further.

Figures 3, 6:
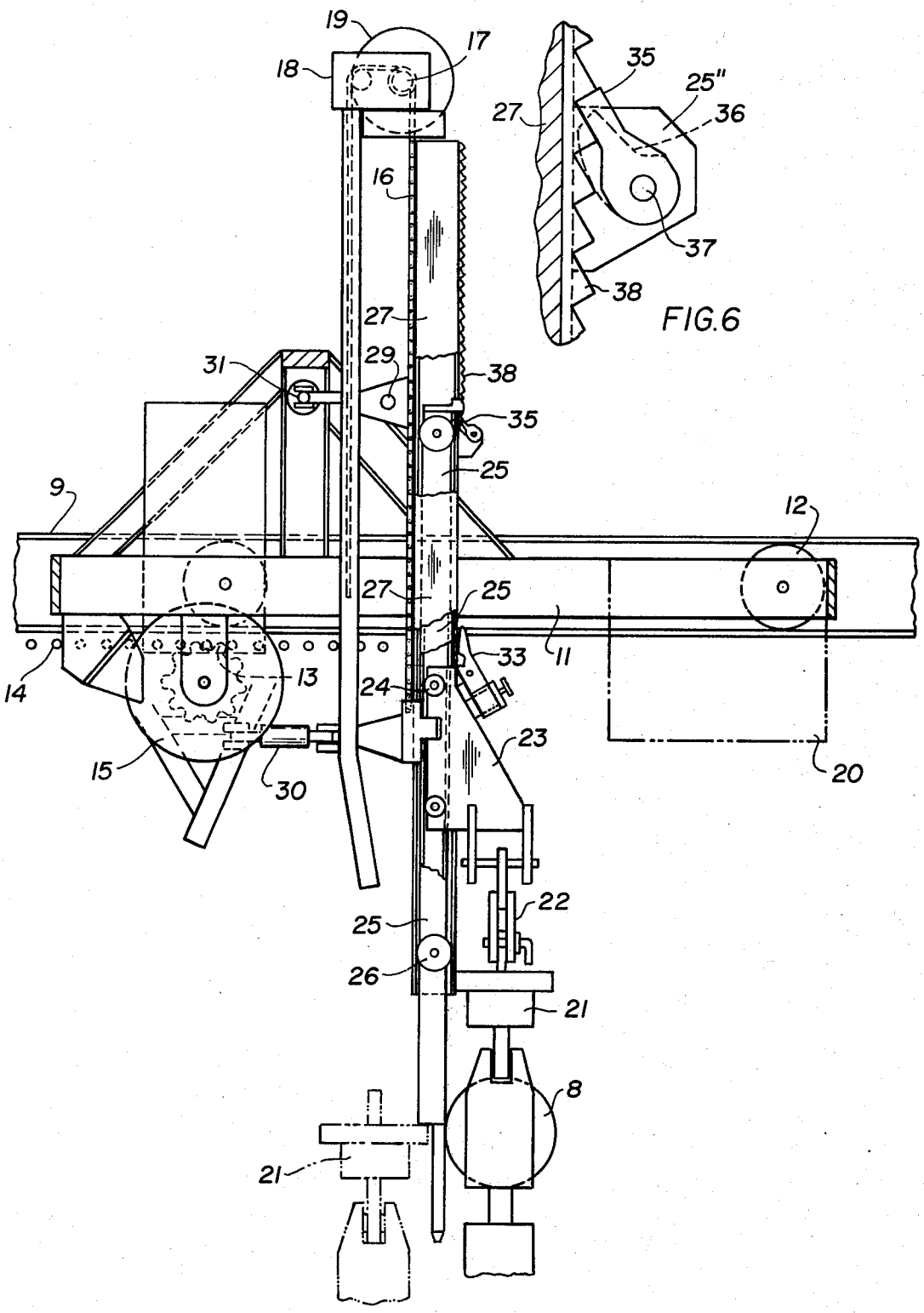
FIG. 3 illustrates the device of FIG. 2 in a different operating condition.
FIG. 6 shows a detail of FIG. 3 on a larger scale.

During upward movement of the carrier 23 and of an attached guide roll 8 from the position shown in FIG. 3, the slide 25 is prevented from being dragged along by the frictionally engaged carrier 23 and guide roll 8. As is shown in detail in FIG. 6, a bracket 25'' on each slide 25 carries a pawl 35 near the cam element 25'. The pawl and a cam 36 are fixedly mounted on a common shaft 37 journaled in the bracket 25'' and are gravity biased toward the illustrated position in which the pawl 35 engages a rack or ratchet 38 on the track 27 and prevents upward movement of the slide 25 until the chain-mounted carrier 23 travels upward over the cam 36 and thereby lifts the pawl 35 from the ratchet 38.

Figure 2:
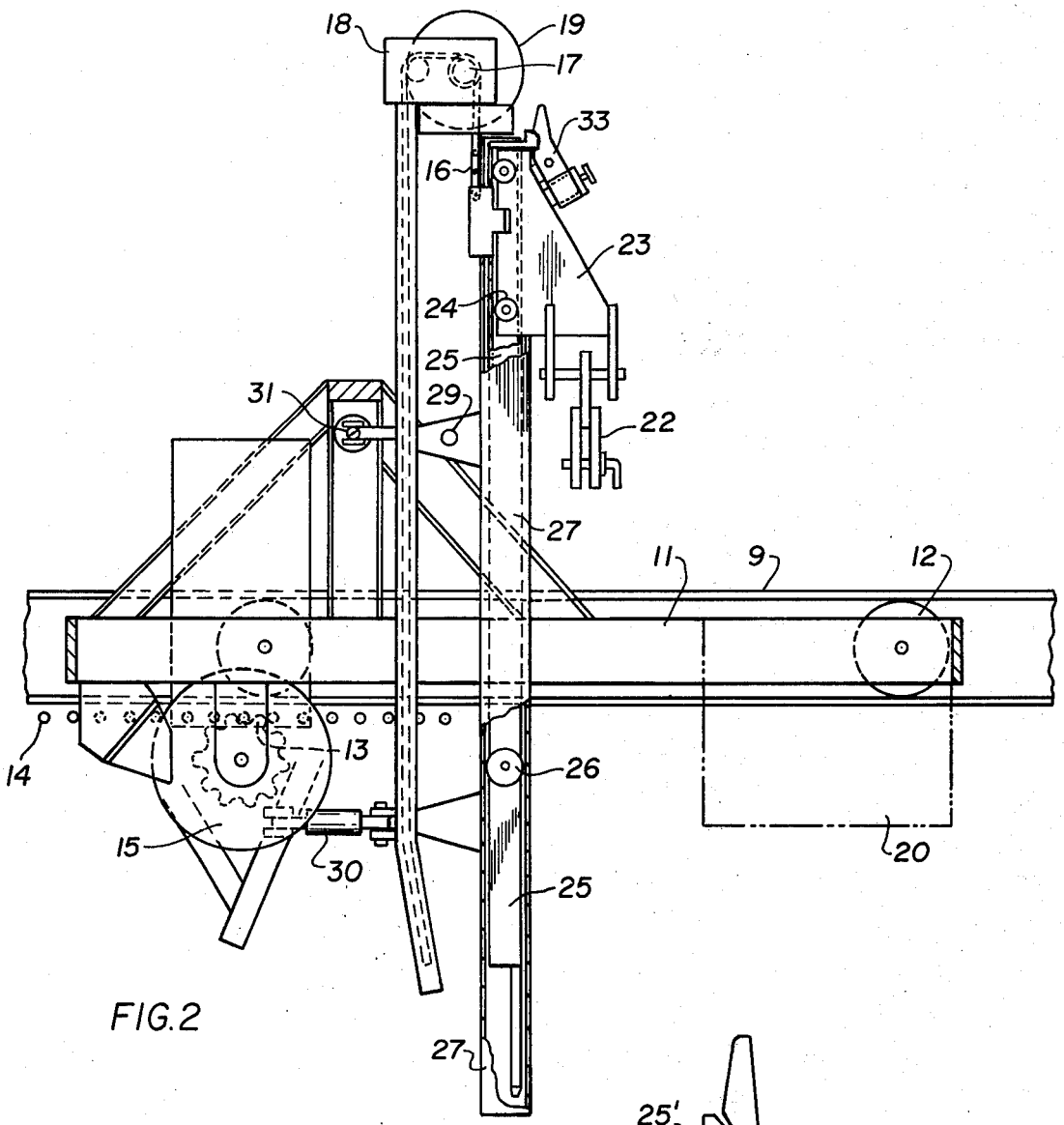
FIG. 2 shows a portion of the apparatus of FIG. 1 on a larger scale.

During lowering of the carrier 23 by the chain 16 from its inactive position shown in FIG. 2, the slide 25 moves downward from the illustrated retracted position until it reaches the projected position seen in FIG. 3 in which it abuts against the cage 21 of a guide roll 8 next to the roll which it is intended to remove from the guide roll rack, and thereby presents a guide face for the vertical hoisting movement of the last mentioned guide roll. During this movement, the slide 25 is held stationary by its pawl 35 until the hoisted guide roll 8 approaches the top of the slide 25, the pawl is released by the rising carrier 23, and the slide 25 is coupled to the carrier by the lever 33. In the position of the slide 25 and the carrier 23 illustrated in FIG. 2, a guide roll 8 depending from the carrier 23 may be transported along the beams 9 by the carriage 10 beyond the guide racks 2,3,4 to a maintenance area, not specifically illustrated. A repaired guide roll or a replacement roll or pair of rolls and the associated cage may be inserted in one of the racks 2,3,4 by reversing the described sequence of steps.

As not explicitly shown in FIGS. 1 to 6 in order not to crowd the drawing, but seen in FIGS. 7 to 11, it is preferred to suspend a bridge 113 from the carriage 10 to accommodate the operator of the hoisting mechanism and the manually operated controls for the several hydraulic devices described above and for the electric motors. The apparatus shown in FIGS. 7 to 11 includes the entire structure described above with reference to FIGS. 1 to 6, and the common elements are only partly shown in FIGS. 7 to 11 and will not again be described.

Figure 9:
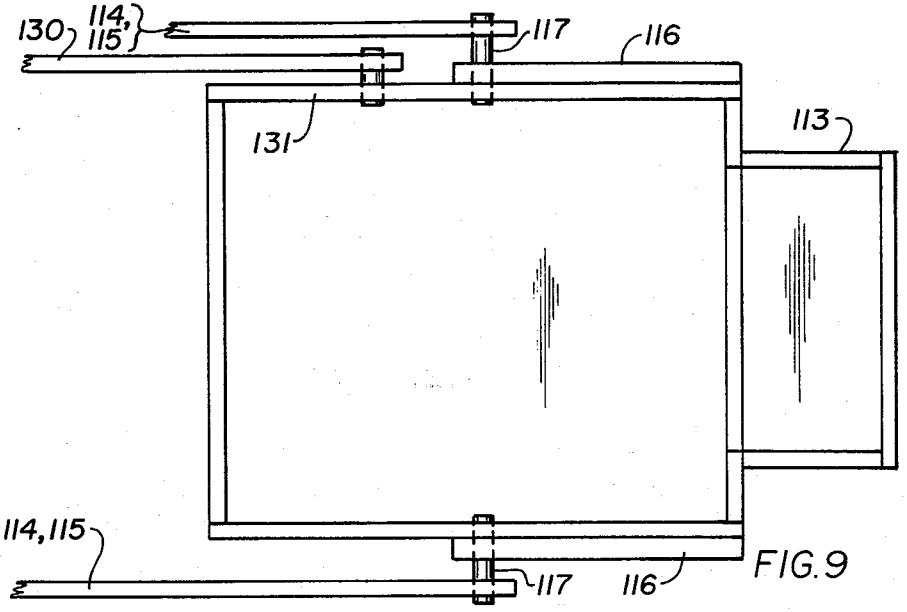
FIG. 9 is a partial top view of the device of FIG. 8.
Figure 8:
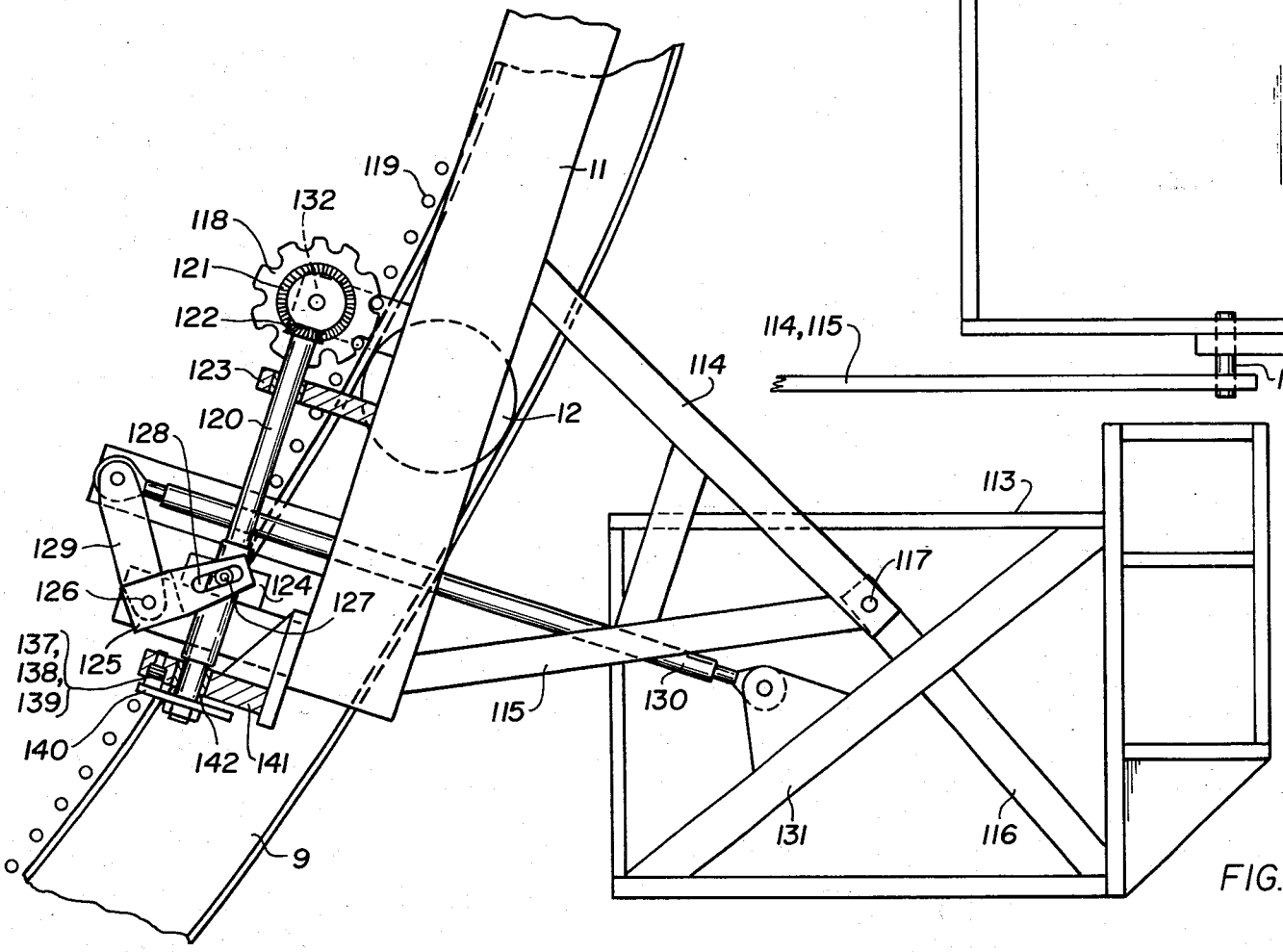
FIG. 8 shows portion of the apparatus of FIG. 7 in enlarged side elevation and in a different operating position.

Only the frame or skeleton of the bridge 113 has been shown in the drawing. It consists of steel bars welded to each other, as far as not described otherwise, and is suspended from the frame 11 of the carriage 10 by steel bars 114,115 on each side of the bridge, each pair of bars, 114,115 being hingedly fastened by a pivot pin 117 to a bar 116 as is shown in FIGS. 8 and 9. The pins 117 have a common horizontal axis parallel to the axes of the guide rolls 8 in all positions of the bridge 113, and are located above the center of gravity of the bridge 113.

Figure 10:
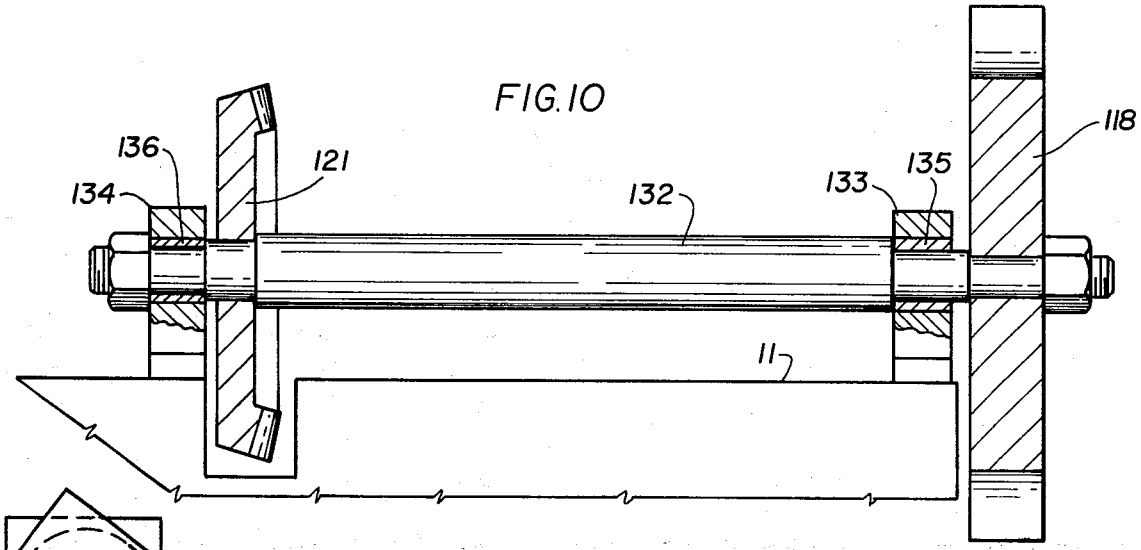
FIG. 10 is another partial top view of the device of FIG. 8.

The bridge is held in a practically constant angular relationship to the vertical by a leveling mechanism which includes a rack 119 extending over the curved portion of one of the beams 9 and engaged by a toothed wheel 118 (FIG. 8). As is best seen in FIG. 10, the wheel 118 and a bevel gear 121 are fixedly mounted on a common shaft 132 which is journaled in bearing blocks 133,134 on the carriage frame 11 by means of permanently lubricated bearing bushings 135,136. As is shown in detail in FIG. 11, the gear 121 meshes with a bevel gear 122 on a partly threaded spindle 120 journaled in bearing blocks 123,141 by means of lubricated bushings 142,143.

The spindle 120 threadedly engages a nut 124 which is received between the two branches of a forked arm 125 of a bell crank lever and prevented from rotating with the spindle 120 by two, diametrically opposite projections 127 engaging longitudinal guide slots 128 in the branches of the arm 125. The bellcrank lever is mounted on the carriage frame 11 by means of a pivot pin 126, and its other arm 129 is connected to a bar 131 of the bridge 113 by a hinged connecting rod 130, as is shown in FIG. 8. The portion of the spindle 120 projecting beyond the bearing block 141 carries a fixedly attached radial flange or brake disc 140. Several stacks of Belleville washers 138 are arranged in circumferentially distributed, axial bores of the bearing block 141. A plunger 137 projects from each stack out of the block 141 toward the nut 124, and a brake shoe 139 projects in the opposite axial direction from the stack toward the brake disc 140.

Figure 11:
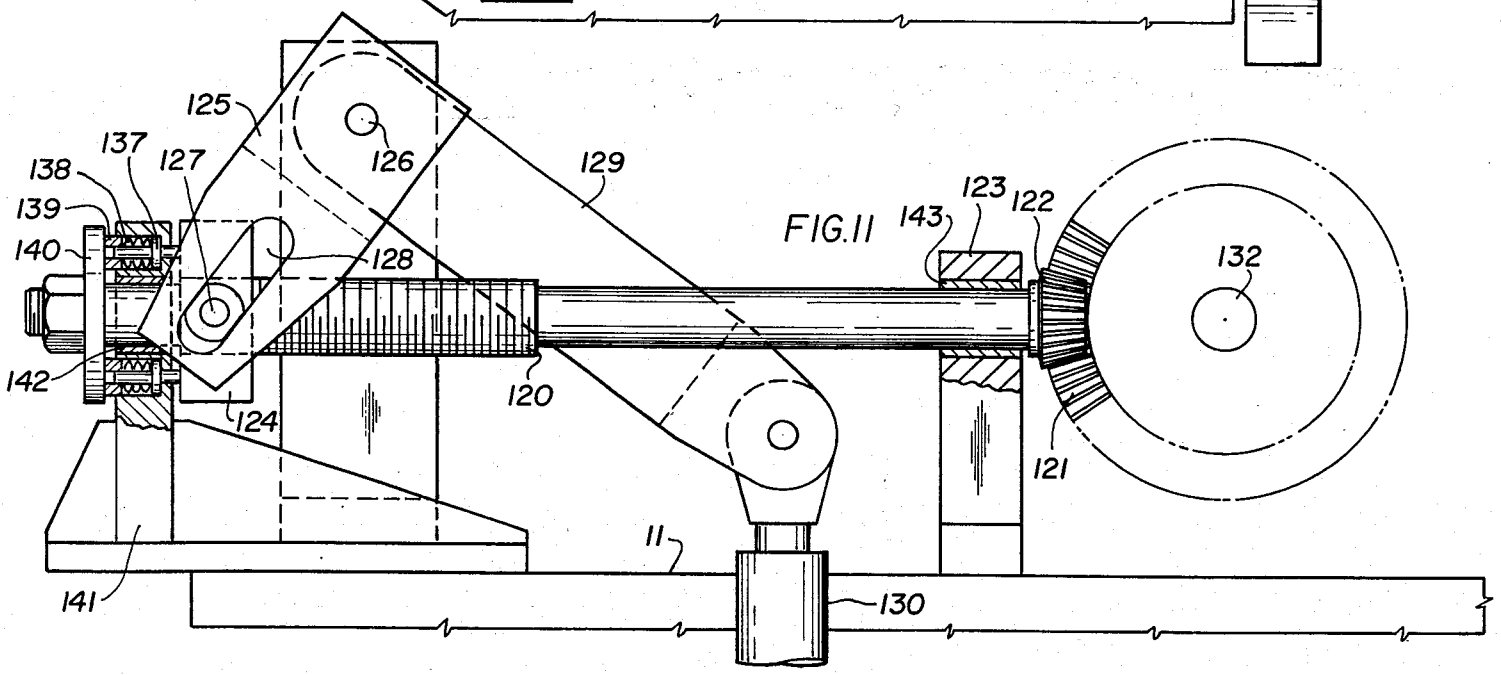
FIG. 11 shows the elements illustrated in FIG. 10 in a different condition of the apparatus.

The curvature of the beams 9 is circular and uniform. The transmission ratio of the motion transmitting train connecting the toothed wheel 118 with the connecting rod 130 is so chosen as to keep the floor of the bridge 113 horizontal while the bridge travels over the curved portions of the beams 9. The length of the threads on the spindle 120 and the position of the nut 124 on the threads are chosen so that the condition of the motion transmitting train illustrated in FIG. 11 is reached when the carriage 10, traveling downward over the curved portions of the beams 9, reaches the straight, horizontal beam portions, and the toothed wheel 118 over-travels the lower end of the rack 119.

The Belleville washers 138 are compressed by the plungers 137 immediately prior to stoppage of the spindle 120, the brake shoes 139 frictionally engage the disc 140, and no further pivotal movement of the bridge 113 about the axis of the pins 117 is possible. The pitch of the threads connecting the nut 124 to the spindle 120 is small enough to prevent the spindle from being turned by the resilient force of the washers 138.

The bridge 113 is held in fixed angular relationship to the carriage 10 while the carriage travels horizontally over the beams 9.

It should be understood, of course, that the foregoing disclosure relates only to a preferred embodiment of the invention, and that it is intended to cover all changes and modifications of the example of the invention herein chosen for the purpose of the disclosure which do not constitute departures from the spirit and scope of the invention set forth in the appended claims.

We claim:

1. Continuous casting apparatus comprising:

a. an upright mold having a downwardly directed orifice for discharging a strand of cast metal;

b. guide rack means for guiding said strand in a first path downwardly away from said orifice, said guide rack means including two rows of rolls defining said path therebetween, said rolls having respective axes of rotation extending in a common horizontal direction;

c. a vehicle;

d. rail means for guiding said vehicle in a second path vertically spaced from said first path and substantially parallel thereto; and e. hoisting means including 1. a track member mounted on said vehicle for pivotal movement about a pivoting axis extending parallel to the axes of the rolls in said common direction and for displacement in said common direction;

2. a slide member mounted on said track member for movement transverse to said common direction and having a face parallel to the direction of movement of said slide member and transverse to said paths, 3. moving means for moving a roll toward and away from said guide rack means in guiding engagement with said face of the slide member, and 4. actuating motor means for continuously moving said track member angularly about said pivoting axis and for displacing said track member in the direction of said pivoting axis.

2. Apparatus as set forth in claim 1, wherein said moving means include a carrier and means for securing the roll to be moved to said carrier, said hoisting means further including coupling means for coupling said slide member to said carrier for joint movement.

3. Apparatus as set forth in claim 2, wherein said hoisting means further include another track member mounted on said vehicle for pivotal movement about said pivoting axis, a second slide member mounted on said second track member for movement transverse to said common direction and having a face parallel to the direction of movement of said second slide member and transverse to said paths, said moving means moving said roll in simultaneous guiding engagement with the faces of said slide members and including a second carrier and means for securing said roll to said second carrier, said hoisting means further including coupling means for coupling said second slide member to said second carrier for joint movement.

4. Apparatus as set forth in claim 3, wherein said moving means include two elongated chains respectively attached to said carriers, and drive means associated with each of said chains for longitudinally moving the associated chain without simultaneously moving the other chain.

5. Continuous casting apparatus comprising:

a. an upright mold having a downwardly directed orifice for discharging a strand of cast metal;

b. guide rack means for guiding said strand in a first path downwardly away from said orifice, said guide rack means including two rows of rolls defining said path therebetween, said rolls having respective axes of rotation extending in a common horizontal direction;

c. a vehicle;

d. rail means for guiding said vehicle in a second path vertically spaced from said first path and substantially parallel thereto; and e. hoisting means including 1. a track member mounted on said vehicle for pivotal movement about a pivoting axis extending parallel to the axes of the rolls in said common direction and for displacement in said common direction;

2. a slide member mounted on said track member for movement transverse to said common direction and having a face parallel to the direction of movement of said slide member and transverse to said paths, 3. a carrier for moving a roll toward and away from said guide rack means in guiding engagement with said face of the slide member, a plurality of wheels on said carrier engaging the slide member for relative movement of said carrier and said slide member, and means for securing the roll to be moved to said carrier, 4. coupling means for coupling said slide member to said carrier for joint movement, the coupling means responding to movement of said carrier into a predetermined position relative to said slide member for coupling the slide member to said carrier, and further responding to stopping of said slide member for disengaging said carrier from said slide member, and 5. actuating motor means for moving said track member angularly about said pivoting axis and for displacing said track member in the direction of said pivoting axis.

6. Apparatus as set forth in claim 5, wherein said slide member is formed with a groove elongated in the direction of movement of said roll by said carrier, said wheels being received in said groove.

7. Continuous casting apparatus comprising:

a. an upright mold having a downwardly directed orifice for discharging a strand of cast metal;

b. guide rack means for guiding said strand in a first path downwardly away from said orifice, said guide rack means including two rows of rolls defining said path therebetween, said rolls having respective axes of rotation extending in a common horizontal direction;

c. a vehicle;

d. rail means for guiding said vehicle in a second path vertically spaced from said first path and substantially parallel thereto; and e. hoisting means including 1. a track member mounted on said vehicle for pivotal movement about a pivoting axis extending parallel to the axes of the rolls in said common direction and for displacement in said common direction;

2. a slide member mounted on said track member for movement transverse to said common direction and having a face parallel to the direction of movement of said slide member and transverse to said paths, 3. a carrier and means for moving the carrier between an inactive position remote from the first path and an active position adjacent the first path for moving a roll toward and away from said guide rack means in guiding engagement with said face of the slide member, and means for securing the roll to be moved to said carrier,
4. coupling means for coupling said slide member to said carrier for joint movement, the coupling means during said joint movement coupling said slide member to said carrier for movement between a retracted position remote from said first path and a projected position adjacent said first path, said coupling means responding to movement of said carrier from said active position toward said inactive position while said slide member is in said projected position by coupling said slide member to said carrier, and said coupling means responding to joint movement of said carrier and said slide member toward said first path from the respective inactive and retracted position, for uncoupling said slide member from said carrier when said slide member reaches the projected position thereof and permitting further movement of said carrier toward said inactive position after said uncoupling, and
5. actuating motor means for moving said track member angularly about said pivoting axis and for displacing said track member in the direction of said pivoting axis.

8. Continuous casting apparatus comprising:

a. an upright mold having a downwardly directed orifice for discharging a strand of cast metal;
b. guide rack means for guiding said strand in a first path downwardly from said orifice, the first path having an arcuate portion adjacent said orifice and a substantially straight portion remote from said orifice, said guide rack means including two rows of rolls defining said path therebetween, said rolls having respective axes of rotation extending in a common horizontal direction;
c. a vehicle;
d. rail means for guiding said vehicle in a second path vertically spaced from said first path and substantially parallel thereto, the second path having arcuate and straight portions corresponding to the portions of the first path;
e. a bridge suspended from said vehicle for pivoting movement about an axis extending in said common direction;
f. leveling means responsive to movement of said vehicle in the arcuate portion of said second path for maintaining a substantially angular relationship between said bridge and the vertical; and
g. hoisting means including
   1. a track member mounted on said vehicle for pivotal movement about a pivoting axis extending parallel to the axes of the rolls in said common direction and for displacement in said common direction;
   2. a slide member mounted on said track member for movement transverse to said common direction and having a face parallel to the direction of movement of said slide member and transverse to said paths,
   3. moving means for moving a roll toward and away from said guide rack means in guiding engagement with said face of the slide member, and
   4. actuating motor means for moving said track member angularly about said pivoting axis and for displacing said track member in the direction of said pivoting axis.

9. Apparatus as set forth in claim 8, wherein the leveling means comprises a connecting rod having two ends, one of the connecting rod ends being pivoted to the bridge, and means for displacing the other connecting rod end, said displacing means including a rack fixed to and extending over the arcuate portion of the rail means, a toothed wheel meshing with the rack, and a gear train coupled between the toothed wheel and the other connecting rod end, the gear train being arranged to convert the rotary movement of the toothed wheel into a linear reciprocating movement of the connecting rod whereby the bridge pivoted thereto is leveled.

10. Apparatus as set forth in claim 8, further comprising brake means for preventing said pivoting movement of said bridge during movement of said vehicle in the straight portion of said second path.

* * * * *